US009192847B2

(12) United States Patent
Holm et al.

(10) Patent No.: US 9,192,847 B2
(45) Date of Patent: Nov. 24, 2015

(54) SKI BRAKE

(71) Applicant: ROTTEFELLA AS, Klokkarstua (NO)

(72) Inventors: Thomas Holm, Oslo (NO); Even Wøllo, Naersnes (NO); Aksel Pettersen, Heer (NO); Øyvar Svendsen, Oslo (NO)

(73) Assignee: ROTTEFELLA AS, Klokkarstua (NO)

( * ) Notice: Subject to any disclaimer, the term of this patent is extended or adjusted under 35 U.S.C. 154(b) by 0 days.

(21) Appl. No.: 14/370,993

(22) PCT Filed: Dec. 21, 2012

(86) PCT No.: PCT/IB2012/002878

§ 371 (c)(1),
(2) Date: Jul. 8, 2014

(87) PCT Pub. No.: WO2013/104952

PCT Pub. Date: Jul. 18, 2013

(65) Prior Publication Data

US 2015/0001832 A1 Jan. 1, 2015

(30) Foreign Application Priority Data

Jan. 13, 2012 (NO) ..... 20120037

(51) Int. Cl.
*A63C 7/10* (2006.01)
*A63C 9/20* (2012.01)

(52) U.S. Cl.
CPC ..... *A63C 7/1026* (2013.01); *A63C 9/20* (2013.01); *A63C 2201/06* (2013.01)

(58) Field of Classification Search
CPC ..... A63C 7/005; A63C 7/1026; A63C 7/1053
USPC ..... 280/604, 605, 607, 613
See application file for complete search history.

(56) References Cited

U.S. PATENT DOCUMENTS 6,623,027 B1 9/2003 Wheeler
6,644,683 B1 11/2003 Hauglin et al.

(Continued)

FOREIGN PATENT DOCUMENTS

DE 20021684 U1 4/2001
EP 1393784 A1 3/2004

(Continued)

OTHER PUBLICATIONS

International Search Report for PCT/IB2012/002878, ISA/EP, Rijswijk, NL, mailed Apr. 25, 2013.

*Primary Examiner* — J. Allen Shriver, II
*Assistant Examiner* — Bryan Evans
(74) *Attorney, Agent, or Firm* — Harness, Dickey & Pierce, P.L.C.

(57) ABSTRACT

The present invention relates to a ski binding (1) with ski brake (50), particularly a touring and telemark binding, comprising a front retaining element (11) and a rear retaining element (15) and also a tensioning device (25) designed to connect the front and rear retaining elements such that they can be locked to a ski boot (5), the front retaining element (1 1), rear retaining element (15) and the tensioning device (25) being designed to rotate upward and forward about an axis of rotation (59) with an opening angle (a) relative to a ski, wherein the ski brake (50) is disposed between an upper surface of the ski and the assembly consisting of front retaining element (11), rear retaining mechanism (15) and the tensioning devices (25), wherein the assembly consisting of front retaining element (11), rear retaining element (15) and tensioning device (25) comprises a plate or a piece (17) that is designed to receive a front section (55) of the ski brake (50), the ski brake (1) being inactive when the front section (55) is received in the opening (17*a*) and where the ski brake (1) is activated when the front section (55) is not received in the opening (17*a*), wherein the plate or piece (17) is designed to bear against the underside of and rotate together with the ski boot (5) sole (7). The invention is characterised in that the front section (55) is provided with engaging means (56) arranged to engage with corresponding engaging means (18) in the plate or piece (17) when the opening angle (a) exceeds a predetermined angle.

5 Claims, 7 Drawing Sheets

(56) References Cited

U.S. PATENT DOCUMENTS

| | | | | |
|---|---|---|---|---|
| 7,458,598 | B2 * | 12/2008 | Giffin et al. | 280/615 |
| 2004/0041366 | A1 * | 3/2004 | Dandurand | 280/631 |
| 2004/0173995 | A1 * | 9/2004 | Dandurand | 280/631 |
| 2004/0207177 | A1 * | 10/2004 | Riedel et al. | 280/611 |
| 2005/0248128 | A1 * | 11/2005 | Hauglin | 280/617 |
| 2007/0126204 | A1 * | 6/2007 | Riedel et al. | 280/615 |

FOREIGN PATENT DOCUMENTS

| | | | |
|---|---|---|---|
| NO | 326646 | B1 | 1/2009 |
| NO | 328592 | B1 | 3/2010 |
| WO | 00/04965 | A1 | 2/2000 |
| WO | 02/089931 | A1 | 11/2002 |
| WO | 03/101555 | A1 | 12/2003 |

* cited by examiner

SKI BRAKE

CROSS-REFERENCE TO RELATED APPLICATIONS

This application is a 371 U.S. National Stage of International Application No. PCT/IB2012/002878, filed Dec. 21, 2012, which application claims the benefit of Norwegian Patent Application No. 20120037, filed Jan. 13, 2012. The disclosures of the above applications are incorporated herein by reference.

The invention relates to a ski brake in accordance with the preamble of claim 1.

Bindings for touring, telemark or cross-country skis differ from alpine bindings in that the heel of the ski boot must be movable and the binding must be capable of permitting advantageous and correct bending of the ski boot. The ski boot and binding must be able to interact in such a way that the telemark position can be assumed in a correct and comfortable manner, whilst the torsional stiffness and/or twisting stiffness is as great as possible so as to obtain good turning properties. In addition, the combination of ski boot and binding should be adapted so that the system is comfortable to walk with in terrain and walk uphill with. These properties and requirements are partly contradictory and will result in the designer, in the traditional way, having to make compromises to some degree. A system with optimal turning and downhill properties will as a rule have poorer touring properties, and vice versa.

NO 326646 teaches a ski binding where the ski boot is held between a front and a rear fixing element in such a way that the heel is freely liftable, and where the front and rear fastening elements are pivotally mounted relative to the binding and the ski. A binding of this kind combines the aforementioned properties in an optimal manner. The binding has two modes, a downhill mode and a walking mode. In the downhill mode, the pivotability the ski binding is partially limited so that the torsional stiffness of the binding system and the control of the ski are optimal. In walking mode, the front part of the ski binding is released so that maximum pivotability is obtained.

In addition to good downhill and walking properties, a good binding system should comprise a release mechanism and a so-called ski brake. If or when the skier falls in such a way that knees or other body joints are subjected to extreme twisting forces, the binding system must be capable of releasing. When the binding system has released, it must not be possible for the ski to slide away freely. Firstly, the ski could pose a substantial safety risk to people and objects in the fall line of the loose ski. Secondly, the skier themself will be exposed to a risk if he or she cannot find their ski again after a fall. The ski brake should function independently of whether the ski binding is in a downhill or touring mode.

NO 328592 teaches, inter alia, a ski brake adapted to a binding system according to NO 326646. The ski brake according to NO 328592 is disposed between an upper surface of the ski and a flat/planar connecting part, with an actuating part of the ski brake in direct contact with the underside of the front end of the ski boot sole, with the result that when the front end of the ski boot is fixed in the front retaining element of the binding, the ski brake will be inactive, and when the binding releases and the front end of the ski boot leaves the front retaining element, the ski brake is activated.

An embodiment of the ski brake according to NO 328592 is designed as a resilient pivoted lever which has a front part (the actuating part) that forms contact with the sole of the ski boot via an opening in the flat/planar connecting part when the binding is in use, a middle region comprising an axle and a back region behind the axle that is U-shaped. It is the arms of the U-shaped part that constitute the braking means when the ski brake is actuated, a tensioning means acting to press the arms of the U-shaped part down past the gliding plane of the ski when the ski brake is actuated. The middle region comprising an axle forms a centre of rotation that defines an arcuate circular sector path that the actuating front part follows. The principle of the ski brake is basically that the ski boot blocks the movement of the actuating front part along the circular sector as long as the ski boot is fixed in the front retaining element of the binding.

The present invention constitutes a further development and/or improvement of the ski brake referred to in NO 328592. To further improve the walking properties of a ski binding of the aforementioned type, whilst maintaining its downhill properties, it is a desired goal to be able to further increase the bending angle of the binding and ski boot when the ski binding is in walking mode. A problem that may arise if the bending angle of the binding and the ski boot is too great is that the ski brake is actuated undesirably without the binding releasing and without the front end of the ski boot leaving the front retaining element. This may happen in the event that the bending angle of the ski boot becomes so large that the actuating part of the ski brake is tilted up past the sole of the ski boot if it is bent so far upward and forward that it no longer blocks the movement of the actuating front part along the circular sector. Another problem that may rise is that the actuating part of the ski brake wears a groove in the sole of the ski boot and/or gets partly stuck in the tread of the ski boot sole. This may affect the function of the binding in that the skier feels that the ski "hangs" at a certain angle, which may impact on the downhill skiing feeling and control of the skis It is an object of the present invention to provide an improved binding system having an improved ski brake that can help to provide a binding system with improved walking function, whilst maintaining the downhill properties of the binding system or even improving them further.

It is another object of the present invention to provide an improved binding system having an improved ski brake that can help to improve the properties of the binding system as regards downhill properties, walking properties, safety and user friendliness.

These and other objects are achieved wholly or partly by means of a device according to claim 1. Advantageous or alternative embodiments are set forth in the dependent claims.

FIGS. 13-15 show the ski brake from the side, the top and behind, respectively.

FIGS. 1 to 12 show a ski binding 1 in accordance with one embodiment of the invention as it appears when installed on a ski (not shown) facing to the left (i.e., its tip should be envisaged to the left of the drawings and its rear end to the right). Some details of the binding 1, such as the mounting plate, heel plate, individual tensioning levers etc., are not shown because they can be regarded as irrelevant in this connection.

Figure 1:
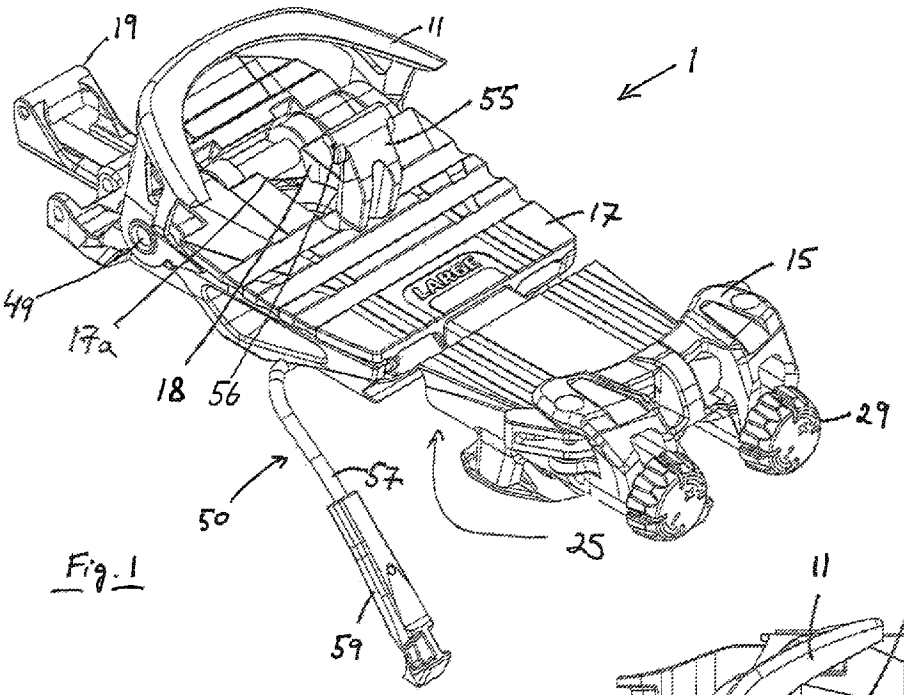
FIG. 1 is a perspective view of a ski binding according to one embodiment of the invention, where a ski brake is shown in the actuated and released state.
Figure 2:
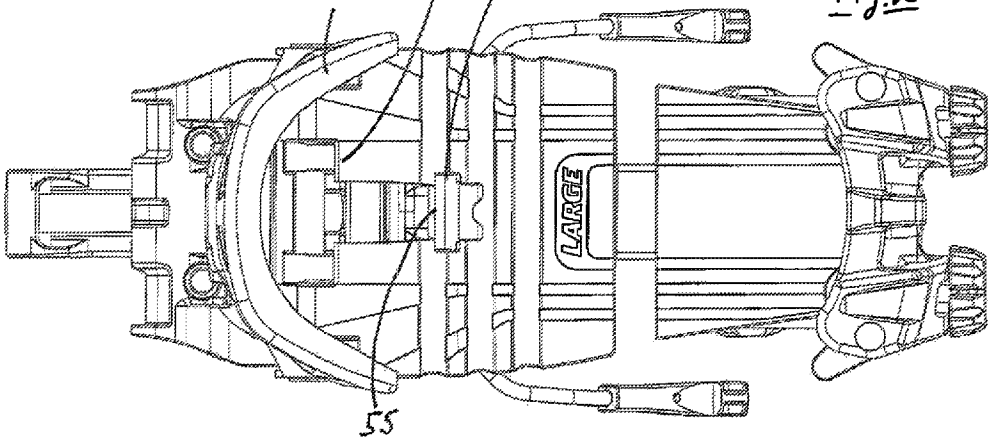
FIG. 2 shows the same as FIG. 1, but seen from immediately above.
Figure 3:
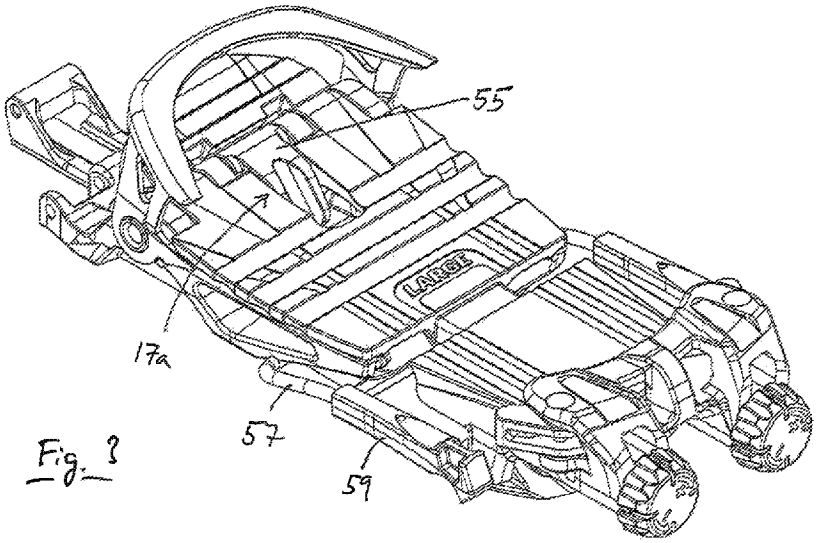
FIG. 3 is a perspective view of a ski binding like that shown in FIG. 1, where the ski brake is shown in locked-down state.
Figure 4:
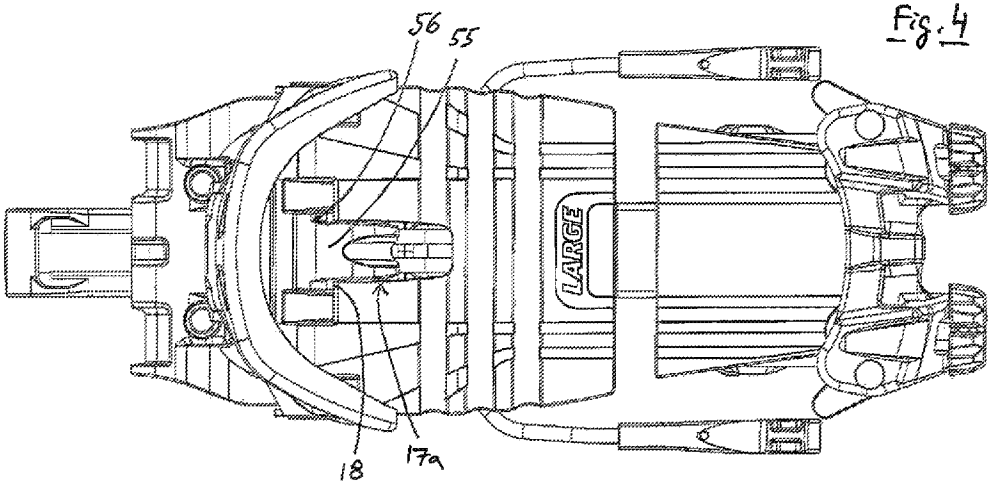
FIG. 4 shows the same as FIG. 3, but seen from immediately above.

FIGS. 1 and 2 show the binding 1 as it will appear when it is not in use and as the skier will find it when he or she gets ready to put on the ski. The binding 1 will appear as a hinged system where a part is mounted fixedly on a ski and another part, which comprises, inter alia, a front retaining element 11, a flexible plastic plate 17 and a rear retaining element 15, can more or less freely rotate about the axis of rotation 49. Tensioning devices 25 will to a certain extent bias the hinged system such that the part comprising, inter alia, the front retaining element 11, the flexible plastic plate 17 and the rear retaining element 15, is held down against the ski, such that the hinged system appears closed. The ski brake 50 is also biased, which it must be in order to provide a braking effect when or if the skier falls and the ski with binding is released. It is this biasing that presses front section 55 of the ski brake 1 up through a longitudinal slot 17*a* in the flexible plastic plate whilst pressing the lateral branches 57 with plastic pads 59 down. When the skier is going to put on the binding/ski, he or she treads the front section 55 down through the longitudinal slot or opening 17*a* using the front end of the ski boot, the front part of the ski boot 5 sole 7 (shown in FIGS. 7-12) being brought down between the front retaining element 11 and the rear retaining element 15, which will at the same time cause the lateral branches 57 with plastic pads 59 to rotate up and come to lie just under the sole 7 along the ski; ref. FIGS. 3 and 4, where the ski boot is not shown, and FIGS. 7 and 8, where a part of a ski boot 5 is shown. Front retaining element 11 and rear retaining element 15 are then drawn together with the aid of tensioning devices suitable therefor.

Figure 5:
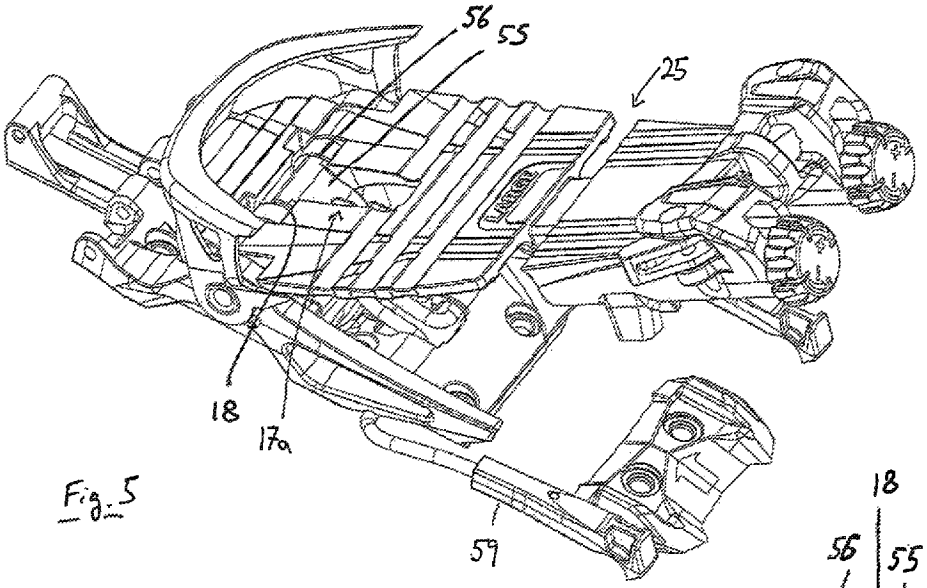
FIG. 5 is a perspective view of the ski binding shown in FIGS. 1 and 3, where the ski brake is in locked-down state and the movable part of the binding is rotated slightly upward.
Figure 6:
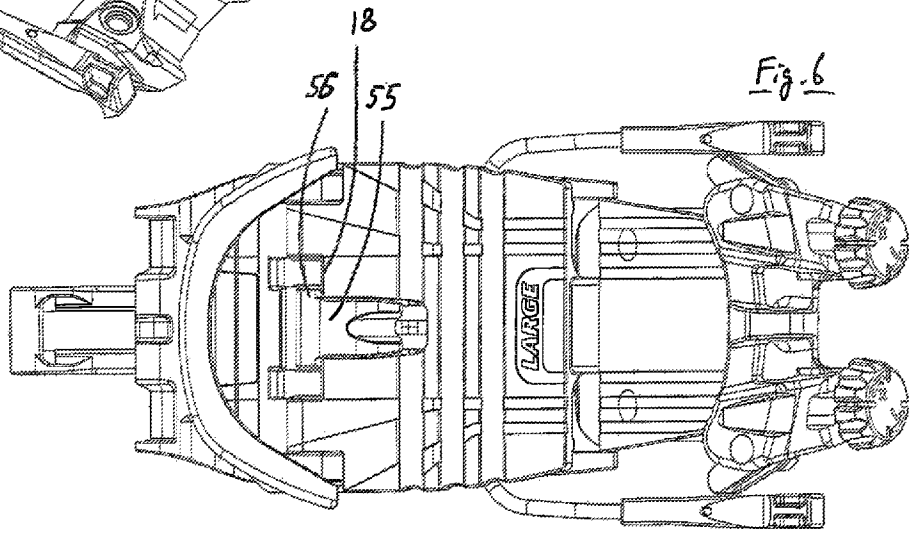
FIG. 6 shows the same as FIG. 5, but seen from immediately above.
Figure 10:
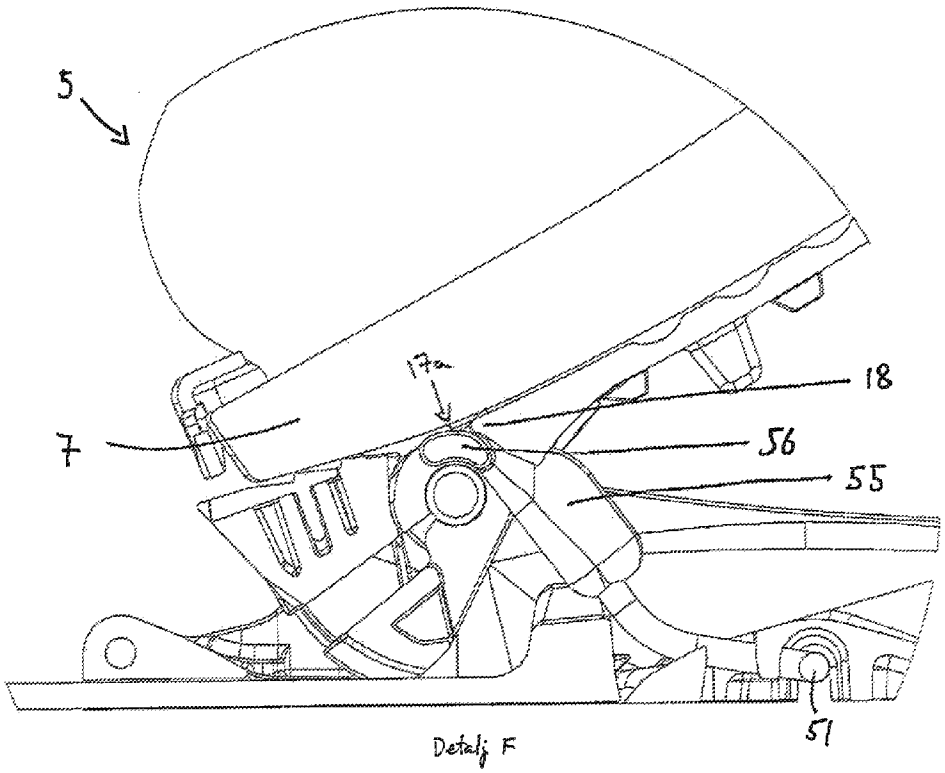
FIG. 10 shows the section A-A in FIG. 9.
Figure 9:
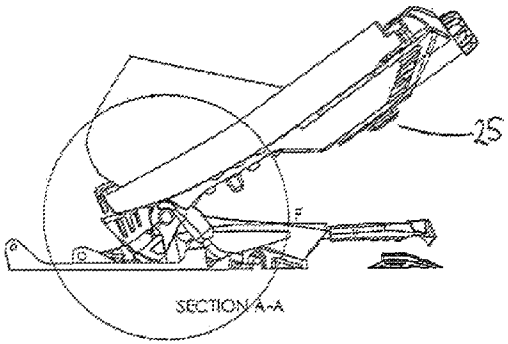
FIG. 9 shows a ski boot secured in a ski binding, where the ski boot is bent slightly upward.
Figure 12:
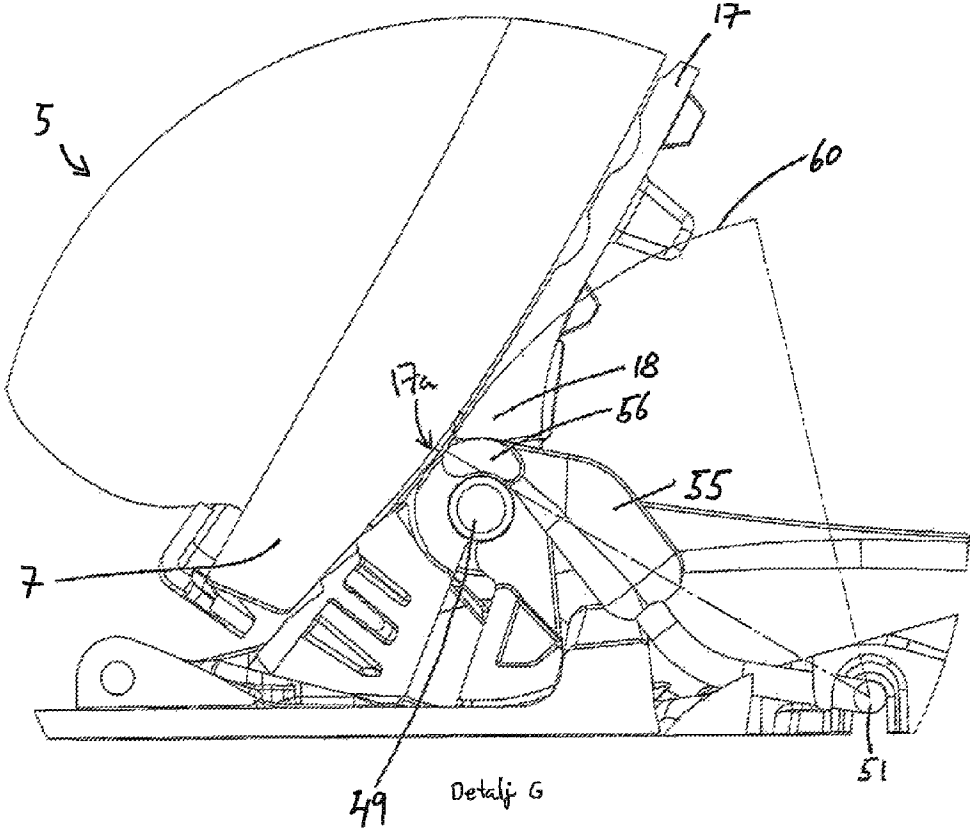
FIG. 12 shows the section A-A in FIG. 11.
Figure 11:
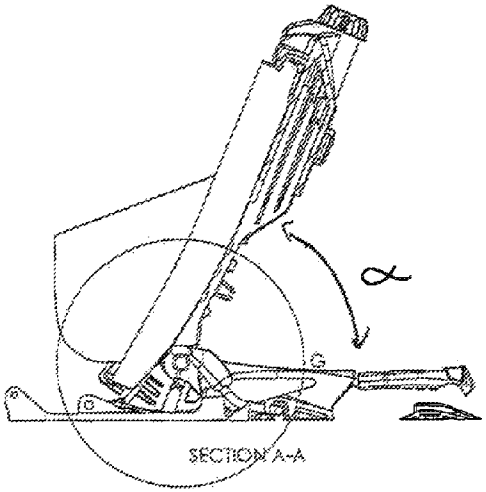
FIG. 11 shows a ski boot that is secured in a ski binding, where the ski boot is bent almost fully upward.
Figure 15:
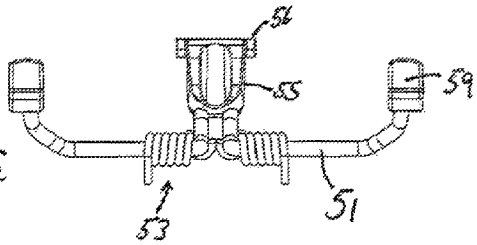
Figure 16:
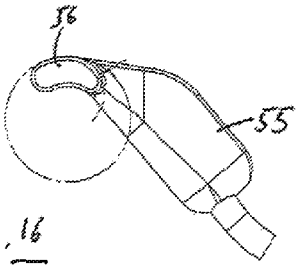
FIG. 16 shows the section B from FIG. 13.
Figure 12:
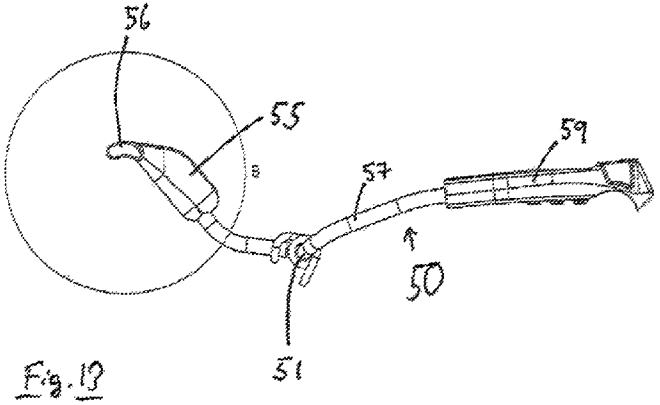
Figure 14:
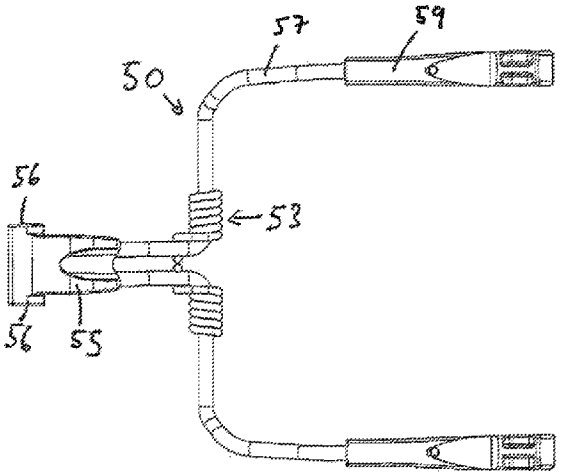

When the ski binding 1 is in walking mode and the skier tilts the ski boot 5 forward, the ski binding 1, comprising the front retaining element 11, the flexible plastic plate 17 and the rear retaining element, will rotate upward and forward around the axis of rotation 59. This is shown in FIGS. 5 and 6 without a ski boot and in FIGS. 9-12 with a part of a ski boot 5. The difference between FIGS. 9/10 and 11/12 is the angle of rotation, FIGS. 11 and 12 showing a larger opening angle $\alpha$. In FIGS. 11 and 12, a circular sector 60 is also shown. If the opening angle $\alpha$ becomes too large, there is a risk that the front section 55 of the ski brake 50 will follow the circular sector 60 without the sole 7 of the ski boot 5 blocking the movement of the front section 55 along the circular sector 60. The effect of this is that the ski brake 50, in some cases, can thus be actuated without the ski boot 5 being released from the binding. This is not a desirable situation, as the ski brake will brake in an undesirable manner. In addition, the front section 55 of the ski brake 50 may jam or become stuck under the ski boot sole, such that the ski boot cannot easily be moved back into a horizontal position again and the ski brake 50 remains actuated.

This problem has hitherto been solved by limiting the opening angle $\alpha$ so that the ski boot 5 sole 7 at all times blocks the movement of the front section 55 along the circular sector 60. However, this limitation of opening angle $\alpha$ also reduces to some extent the walking properties of the ski binding 1, and it is a desired goal to increase this opening angle $\alpha$ in order to improve the walking properties of the ski binding, whilst maintaining its good downhill properties.

According to the present invention, a ski brake 1 is provided where the front section 55 is equipped with engaging means 56 that are arranged to engage with corresponding engaging means 18 in the plate or piece 17 when the opening angle $\alpha$ exceeds a predetermined angle.

According to the present invention, the front section 55 of the ski brake 50 is provided with means that prevent the ski brake 50 from being actuated when the opening angle $\alpha$ of the binding is larger than a predetermined appropriated angle. A solution of this kind ensures that it is still as easy to tread the ski brake 50 down and put on the binding, whilst the ski brake 50 remains unactuated when opening angle $\alpha$ is greater than the predetermined appropriate angle. Should the ski binding 1 be released whilst the ski boot 5 and the binding 1 have an opening angle $\alpha$ greater than the predetermined appropriate angle, the tensioning devices 25 will pull the front retaining element 11, the flexible plastic plate 17 and the rear retaining element 15 down against the ski, thereby reducing the opening angle $\alpha$ and allowing the ski brake 50 to actuate. The solution according to the present invention will therefore not have an adverse effect on the braking ability or function of the ski brake 50.

Although the plate or piece 17 is shown as a flexible plastic plate 17 in the figures, it will be understood that the plate or piece 17 needs neither to be flexible nor to be of plastic. It also does not need to have the same extent or shape as shown in the figures. The plate or piece 17 may be a part of the front retaining element 11, the toe piece, the rear retaining element 15, or it may be a separate part.

Although it is shown that the front section 55 of the ski brake 1 is received in longitudinal slot 17*a* in the plate or piece 17, the plate or piece 17 need not comprise a longitudinal slot 17*a* in order to achieve the objects of the invention. According to the invention, the plate or piece 17 must be designed to receive a front section 55 of the ski brake 50, such that the ski brake 1 is inactive when the front section 55 is received in the plate or a piece 17 and where the ski brake 1 is activated when the front section 55 is not received in the plate or a piece 17.

According to an embodiment of the present invention, the engaging means 56 arranged on the front section 55 comprise at least one projecting wing, lug or pin.

According to an embodiment of the present invention, said projecting wing, lug or pin 56 runs transverse to the longitudinal direction of the ski and the binding 1.

According to an embodiment of the present invention, the corresponding engaging means 18 in the plate or piece 17 are configured as at least one edge, groove, projecting wing, lug or pin.

According to an embodiment of the present invention, the plate or piece 17 may be designed such that the ski boot 5 sole 7 bears against the front section 55 of the ski brake 50 when the opening angle $\alpha$ does not exceed the predetermined angle. Furthermore, the plate or piece 17 may be designed such that the engaging means 56 on the front section 55 of the ski brake 50 bears against the corresponding engaging means 18 in the plate or piece 17 when the opening angle $\alpha$ exceeds the predetermined angle.

Figure 8:
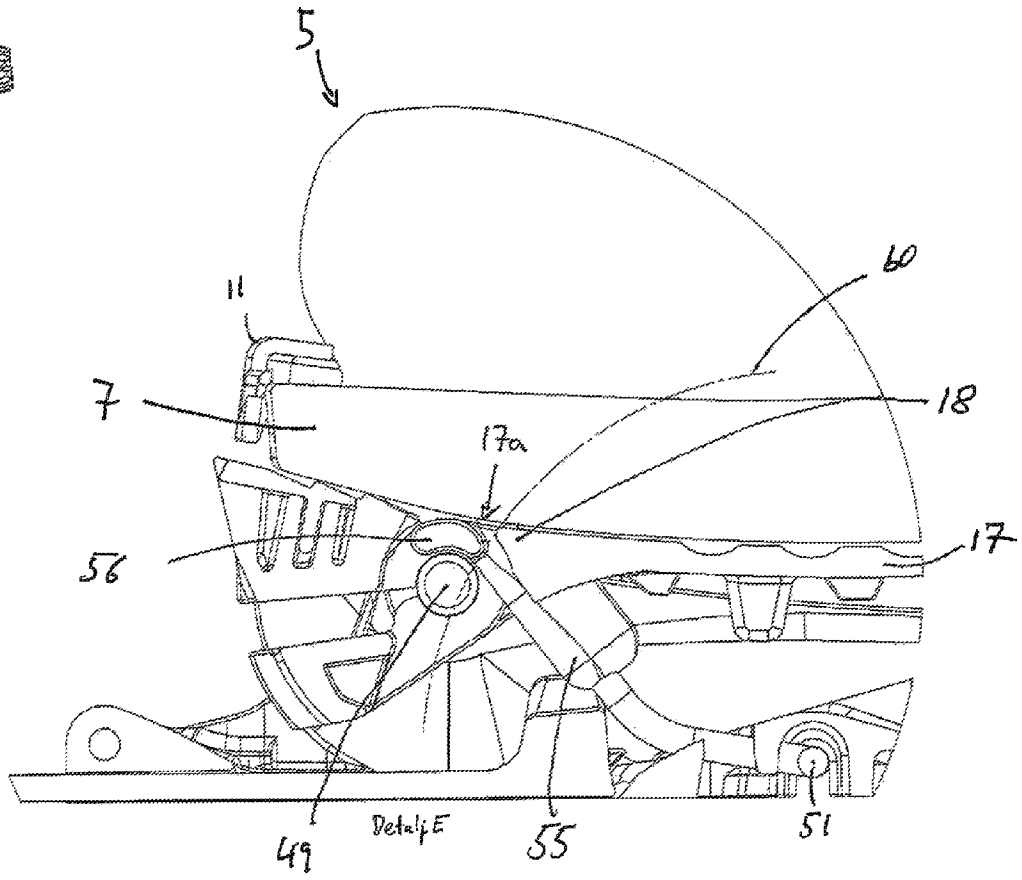
FIG. 8 shows the section A-A in FIG. 7.
Figure 7:
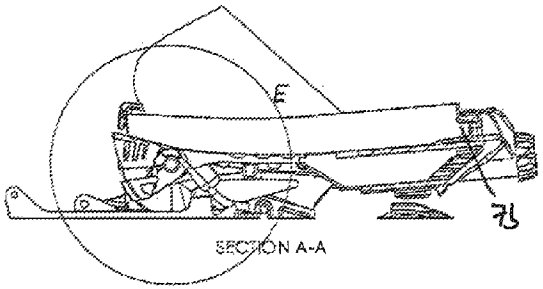
FIG. 7 shows a ski boot that is secured in a ski binding.

According to the embodiment of the present invention shown in the figures, front section 55 of the ski brake 50 is provided with two projecting wings, lugs or pins 56. The wings, lugs or pins 56 run transverse to the longitudinal direction of the ski and the binding 1. At the same time, the longitudinal slot or opening 17*a* is so configured as to be able to receive the front section 55 with the two projecting wings 56 when the opening angle α is less than the predetermined appropriate angle. In addition, the longitudinal slot or opening 17*a* behind the two projecting wings, lugs or pins 56 is configured with corresponding edges, grooves, projecting wings, lugs or pins 18, these being designed to engage with the two projecting wings, lugs or pins 56 when the opening angle α of the binding exceeds the predetermined angle. In FIG. 8, it can be seen that the opening angle α of the binding is so small that the front section 55 of the ski brake 50, which is provided with the two projecting wings, lugs or pins 56, can easily slip out of the longitudinal slot or opening 17*a*, past the corresponding edges, grooves, projecting wings, lugs or pins 18. In FIGS. 10 and 12, the opening angle α has become so large that the front section 55 of the ski brake 50, provided with the two projecting wings, lugs, or pins 56, cannot slip out of the longitudinal slot or opening 17*a*, past the corresponding edges, grooves, projecting wings, lugs or pins 18. There is thus no way that the ski brake 50 can be actuated when the opening angle α is larger than the predetermined appropriate angle.

The solution according to the present invention is not limited to the configurations that are shown in the figures. If the front section 55 of the ski brake 50 were to have a different configuration, for example, be H- or U-shaped, the horizontal part of the H or U could form the element 56. In the last-mentioned cases, the longitudinal slot or opening 17*a* and the corresponding edges, grooves, projecting wings, lugs or pins 18 would also have to be reconfigured to be able, respectively, to receive the front section 55, when the boot 5 is to be fastened in the binding 1, and retain the front section 55, when the opening angle α exceeds the predetermined appropriate angle.

In the exemplary embodiment shown in the figures and discussed in this description, reference is made to a flexible plastic plate 17 and a longitudinal slot 17*a* in this flexible plastic plate 17. The illustrated flexible plastic plate 17 is shown as one piece extending between the front retaining element 11 and the rear retaining element 15. It will be understood that the invention is not limited to such an embodiment and that the illustrated flexible plate 17 may be replaced by a plate or piece 17 which, for example, lies only under the front part of the ski boot 5 sole 7. In addition, the slot or opening 17*a* need not be longitudinal; it may have any other suitable configuration.

The predetermined appropriate angle at which the engaging means 56 in the front section 55 engage with the corresponding engaging means 18 in the plate or piece 17 can be adapted as required. It can, for example, be chosen so as to allow some play or clearance in the event that snow or ice should become packed under the flexible plastic plate 17, which may prevent the hinged system, comprising, inter alia, the front retaining element 11, the plate or piece 17 and the rear retaining element 15, from being brought down fully against the ski. By allowing a little play, the binding can be fastened to the boot 5 even if snow or ice has become packed under the flexible plastic plate 17. In the embodiment shown in the figures, the angle at which the engaging means 56 in the front section 55 engage with the corresponding engaging means 18 in the plate or piece 17 is about 4°. It will be understood that this angle can be either larger or smaller. To avoid wear on the ski boot 5 and undesirable release of the ski brake 50, the angle should be relatively small, i.e., in the range 1-20°. If the purpose is only to avoid undesirable release of the ski brake 50, the angle may be larger, i.e., larger than 10-20°.

The configuration of the two wings, lugs or pins 56, and of the edge 18 can be adapted so that the system does not offer undesirable resistance or in another way impact negatively on the bending and functional properties of the ski binding 1. The configuration of the two wings, lugs or pins 56, and of the edge 18 can also be adapted such that any snow or ice that might penetrate into open spaces around the parts can more easily be dislodged or pushed out.

List of Reference Numerals

1 ski binding
5 ski boot
7 front part of the sole
7*a* edge of the sole
7*b* rear end of the sole
11 front retaining element (toe piece)
15 rear retaining element
17 connecting plate/plate/piece
17*a* opening/longitudinal slot
18 corresponding engaging means/edge/groove/projecting wing/lug/pin
19 unlocking device
25 tensioning device
29 adjustment screw
49 fixation and rotation axle
50 ski brake (pivoted lever)
51 axle
53 torsion spring
55 front/actuating section
56 engaging means/wing/lug/pin
57 lateral branches
59 plastic pad
60 circular sector
α opening angle

The invention claimed is:

1. A ski binding with ski brake, particularly a touring and telemark binding, comprising:

a front retaining element and a rear retaining element and also a tensioning device designed to connect the front and rear retaining elements such that they can be locked to a ski boot, the front retaining element, rear retaining element and the tensioning device being designed to rotate upward and forward about an axis of rotation with an opening angle relative to a ski, wherein the ski brake is disposed between an upper surface of the ski and the assembly consisting of front retaining element, rear retaining mechanism and the tensioning devices, wherein the assembly consisting of front retaining element, rear retaining element and tensioning device comprises a plate or a piece that is designed to receive a front section of the ski brake, the ski brake being inactive when the front section is received in the plate or a piece and where the ski brake is activated when the front section is not received in the plate or a piece, wherein the plate or piece is designed to bear against the underside of and rotate together with the ski boot sole, wherein the front section is provided with engaging means arranged to engage with corresponding engaging means in the plate or piece when the opening angle exceeds a predetermined angle.

2. The ski binding according to claim 1, wherein the engaging means arranged on the front section comprise at least one projecting wing, lug or pin.

3. The ski binding according to claim 2, wherein said projecting wing, lug or pin runs transverse to the longitudinal direction of the ski and the binding.

4. The ski binding according to claim 1, wherein the corresponding engaging means in the plate or piece are configured as at least one edge, groove, projecting wing, lug or pin.

5. The ski binding according to claim 1, wherein the plate or piece is designed such that the ski boot sole bears against a front section of the ski brake when the opening angle does not exceed the predetermined angle, the plate or piece being designed such that the engaging means on the front section of the ski brake bear against the corresponding engaging means in the plate or piece when the opening angle exceeds the predetermined angle.

* * * * *